United States Patent [19]

Gurries et al.

[11] Patent Number: 4,679,268

[45] Date of Patent: Jul. 14, 1987

[54] METHOD AND APPARATUS FOR BURNING SOLID WASTE PRODUCTS USING A PLURALITY OF MULTIPLE HEARTH FURNACES

[75] Inventors: Richard M. Gurries, Saratoga; Jay K. Johnson, La Honda; Eric A. Nering, Moss Beach, all of Calif.

[73] Assignees: Gurries & Okamoto, Inc., Cupertino, Calif.; Associated Mechanical Contractors, Inc., Greensboro, N.C.

[21] Appl. No.: 906,287

[22] Filed: Sep. 11, 1986

[51] Int. Cl.[4] ..... F23G 7/06

[52] U.S. Cl. ..... 110/346; 110/190; 110/212; 110/214; 110/230; 110/247; 110/252

[58] Field of Search ..... 110/346, 203, 208, 210–212, 110/214, 229, 230, 233, 235, 247, 251–252, 255–259, 267–268, 275, 286–288, 295–296, 185, 188, 190; 432/137, 139; 431/5

[56] References Cited

U.S. PATENT DOCUMENTS

| | | | |
|---|---|---|---|
| 1,881,732 | 10/1932 | Lewers | 432/131 X |
| 2,104,526 | 1/1938 | Raisch | 432/129 |
| 2,286,309 | 6/1942 | Rowen | 110/346 X |
| 2,655,883 | 10/1953 | Martin | 110/212 X |
| 3,491,707 | 1/1970 | Bakker | 110/212 |
| 3,658,482 | 4/1972 | Evans et al. | 110/212 X |
| 3,766,866 | 10/1973 | Krumm | 110/190 |
| 3,780,676 | 12/1973 | Hazzard et al. | 110/212 X |
| 4,038,032 | 7/1977 | Brewer et al. | 110/212 X |
| 4,050,389 | 9/1977 | von Dreusche, Jr. | 110/190 |
| 4,182,246 | 1/1980 | Lombana et al. | 110/188 |
| 4,215,637 | 8/1980 | Lombana | 110/346 X |
| 4,253,404 | 3/1981 | Leonard | 110/188 |
| 4,253,409 | 3/1981 | Wormser | 110/230 X |
| 4,261,268 | 4/1981 | von Dreusche et al. | 110/346 X |
| 4,407,206 | 10/1983 | Bartok | 110/230 X |
| 4,459,923 | 7/1984 | Lewis | 110/190 X |
| 4,568,271 | 2/1986 | Mallek | 110/229 X |

*Primary Examiner*—Albert J. Makay
*Assistant Examiner*—Steven E. Warner
*Attorney, Agent, or Firm*—Wigman & Cohen

[57] ABSTRACT

Method and apparatus for incinerating low density organic materials using a pair of side by side multiple hearth furnaces are disclosed. The first furnace of the pair operates in a temperature-controlled reducing atmosphere to achieve complete volatilization of non-fixed carbon contained in the fuel feed stock. The second furnace operates in a temperature-controlled oxidizing atmosphere to achieve complete oxidation of all fixed-carbon contained in the char output of the first furnace. The gaseous products of both furnaces are combined and burned in a low - Btu gas burner, thus providing the heat input to a power boiler or other process suited to the heat quality produced.

26 Claims, 4 Drawing Figures

METHOD AND APPARATUS FOR BURNING SOLID WASTE PRODUCTS USING A PLURALITY OF MULTIPLE HEARTH FURNACES

BACKGROUND OF THE INVENTION

1. Field Of The Invention

The present invention relates generally to the combustion of organic materials and more particularly to improved combustion of low density (less than 30 lbs/cu. ft.), low moisture (less than 15%), high fuel nitrogen (greater than 0.5%), agricultural and forest product wastes. Such fuels present unique combustion problems that make firing in plants designed for coal and other traditional fossil fuels impractical from either cost and/or reliability and availbility standpoints.

2. Description Of The Prior Art

Conventional multiple hearth furnaces include a plurality of hearths superposed in vertically spaced relationhip. The fuel material is introduced in the uppermost hearth and is moved by rabble arms across the hearth floors to eventually fall through drop holes to the hearths below. In this manner, the fuel material travels downwardly in a serpentine path. The product discharged from the lowermost hearth contains ash and possibly significant amounts of unburnt fixed carbon, depending on the sizing and combustion control philosophy utilized.

Conventional control strategies for multiple hearth furnace exist to control combustion phenomena to the extent that certain gross parameters are controlled as dictated by either limitations of the hardware and materials of construction, by laws having jurisdiction over the composition and quantities of exhaust products produced, or by gross combustion strategies. For example, automatic temperature controls limit the hearth temperatures to levels below the failure points of the furnace construction. Staged combustion with afterburner, reducing and oxidizing zones improves combustion efficiency and lowers NOx emissions. Feedback from oxygen and CO analyzers control the combustion air to fuel ratios, resulting in further improved combustion efficiencies.

Conventional practice recognizes the advantage of staged combustion in burning organic materials, and in the case of multiple hearth furnace design, attempts have been made to realize both reducing and oxidizing combustion zones in a single furnace shell with common center shaft and rabble arm drive. Combining both zones in a common shell forces compromises in combustion strategies and results in complications of hardware design.

The transition from reducing to oxidizing zones using a multiple hearth furnace as the combustor has to-date presented a significant isolation problem. Multiple hearth furnace designs to-date have attempted to solve this problem with a combination of mechanical seals, controls and product feed devices that limit gas flow from the oxidizing to the reducing zones. The isolation means attempted have proven to be imperfect to the extent that some transfer of gases between zones can occur under certain operating conditions, resulting in process upsets and decreased combustion rate of efficiency, or inflexibility in zone transition definition, resulting in under-utilization of the furnace built, or disharqe of a waste ash product that contains significant unburnt carbon, representing a loss in overall combustion efficiency.

The isolation means attempted have in some cases been suited to dense materials only, relying on product weight to force open spring or counter-balanced valves. Existing designs of mechanical isolation means often locates the sealing or isolating device in a hot, restricted access area, resulting in limited service life and difficult maintenance, which promotes operation of the system with a failed seal, and the resulting decrease in combustion efficiency.

Exemplary of the prior art which disclose one or more of the concepts noted above are U.S. patents to Lewers (U.S. Pat. No. 1,881,732), von Dreusche (U.S. Pat. No. 4,050,389), Bakker (U.S. Pat. No. 3,491,707), Anderson (U.S. Pat. No. 3,444,687), Evans (U.S. Pat. No. 3,658,482), Hazzard (U.S. Pat. No. 3,780,676), Brewer (U.S. Pat. No. 4,038,032), Raische (U.S. Pat. No. 2,104,526), Martin (U.S. Pat. No. 2,655,883) and Lombana (U.S. Pat. No. 4,182,246).

Lewers discloses the broad concept of separating the oxidation section from the reducing section in a MHF and preventing the gases evolved during oxidation from entering the reducing section. Martin and Raische further teach mechanically conveying the product leaving the drying zone to the oxidation zone, without allowing the oxidation gases to enter the drying zone. None of the prior art patents, however, disclose or suggest the method of burning organic materials using the multiple hearth furnace arrangement of the present invention.

OBJECTS OF THE INVENTION

An object of the present invention is to provide an improved method and means for combusting organic materials to produce useful heat utilizing multiple hearth furnaces as the primary combustor.

Another object of the present invention is to provide an improved method and means of separating and isolating the reducing and oxidizing zones that occur in staged combustion of organic materials, regardless of the specific fuel utilized, where a multiple hearth furnace is the combustor utilized.

Still another object of the present invention is to provide improved ways and means for efficiently incinerating waste products, such as, agricultural and forest products, having low density, high nitrogen and fines content, effectively limiting and controlling slagging and fouling normally associated with such products.

Still another object of the present invention is to provide flexibility in the combustion strategy, to allow production of char as an end product, to allow storage and/or re-introduction of char into the combustion process to fit energy demand needs and availability of char as a fuel.

A still further object of the present invention is to provide method and means for burning waste products having high nitrogen content without forming excess amounts of nitrogen oxides ($NO_x$).

Yet another object of the present invention is to provide a control system for the reducing zones which is highly effective in maintaining proper temperature and air flow characteristics.

Other objects and advantages of the present invention will become apparent from the description and drawings which follow.

SUMMARY AND ADVANTAGES OF THE INVENTION

In order to accomplish the above-identified objects the present invention utilizes a pair of multiple hearth furnaces to decompose organic materials to produce a low Btu fuel gas. The resulting gases are burned in a burner designed for low Btu gas operation using preheated combustion air.

Briefly, solid organic waste material, such as, corn stalks, wood chips, or the like is introduced into the uppermost hearth of the first furnace, and ignited by auxiliary burners. As the material moves downward in the first furnace, temperature controls modulate combustion air introduction in reverse direction, so that the combustion process utilizes a stoichiometric insufficient amount of oxygen (reducing mode) at a temperature of about 1600° F. The oxygen provided in the reducing furnace is approximately 20–50% of stoichiometric. The reducing furnace is designed to drive off all of the volatile material in the fuel being partially combusted, leaving only char and ash to be discharged from the lowermost hearth of the furnace. Fuel bound nitrogen is also driven off with the volatiles. Most of the nitrogen exits the furnace as non-oxidized compounds of nitrogen ($N_2$, $NH_3$, HCN etc.) due to the deficient oxygen combustion atmosphere and the low combustion temperatures. The hot evolved volatile gases have a low Btu value but are recovered and subsequently burned.

The char and ash is then introduced into the uppermost hearth of the oxidizing furnace which is operated at a temperature of about 1400° F. This char material moves downwardly through the oxidizing furnace, while temperature controls modulate combustion air introduction in a forward direction. The combustion process in the oxidizing furnace is carried out using an excess of stoichiometric oxygen required for complete combustion of the fixed carbon in the char. Preferably, a 150% or more excess oxygen is employed.

The hot evolved gases from the oxidizing furnace is also recovered and transferred to a low Btu gas burner where it provides oxygen and heat energy for burning the low Btu gases from the reducing furnace. This burner is preferably mounted in a water-wall boiler or other radiant-heat absorbing process apparatus, so that a substantial part of the radiant energy output of the flame is directly absorbed, limiting the flame temperature and resultant pollution effects. A NOx analyzer is optionally employed to monitor the NOx content and to adjust the flame temperature accordingly.

The ducting arrangement employed in the present invention allows removal of all or part of the product gases from the side of the hearths, thereby minimizing gas flow between hearths through the drop holes. Gas flow through drop holes can cause operating problems with some fuels, such as air entrainment of fines, char and ash, as well as localized hot-spot burning and slagging. Therefore, the present invention also avoids problems associated with gas flows between hearths through drop holes.

The ducting arrangement employed utilizes a separate draft control damper and draft controller for each furnace, thereby allowing the draft setpoint for each furnace to be set independently. This minimizes "tramp" air infiltration and pressure upsets or swings that might cause further process upsets.

By completely separating the reducing furnace from the oxidizing furnace, the following notable advantages are realized in the control of pollutants, slagging and fouling that might otherwise occur:

1. Localized hot spots which result from the leakage of oxygen containing gases into the reducing zone of a staged combustion process are prevented. These hot spots will in turn increase NOx emissions, slagging of the fuel material, and vaporization of materials that may cause downstream fouling of heat transfer surfaces.

2. A more accurate temperature control in each hearth, tailored to the characteristics of the fuel being burned is ahieved.

3. A perfect sealing between the reducing zones and the atmosphere is readily obtained, since the shaft seals are in a mild ambient environment, with easy access and maintenance; this positively eliminates uncontrolled entry of air and the resulting hot-spot burning.

4. The design of each furnace hearth size, height, rabble arm pattern and speed can be independently tailored to best fit the process of reduction atmosphere burning or excess air atmosphere burning.

DETAILED DESCRIPTION OF THE PREFERRED EMBODIENT

Figure 1A:
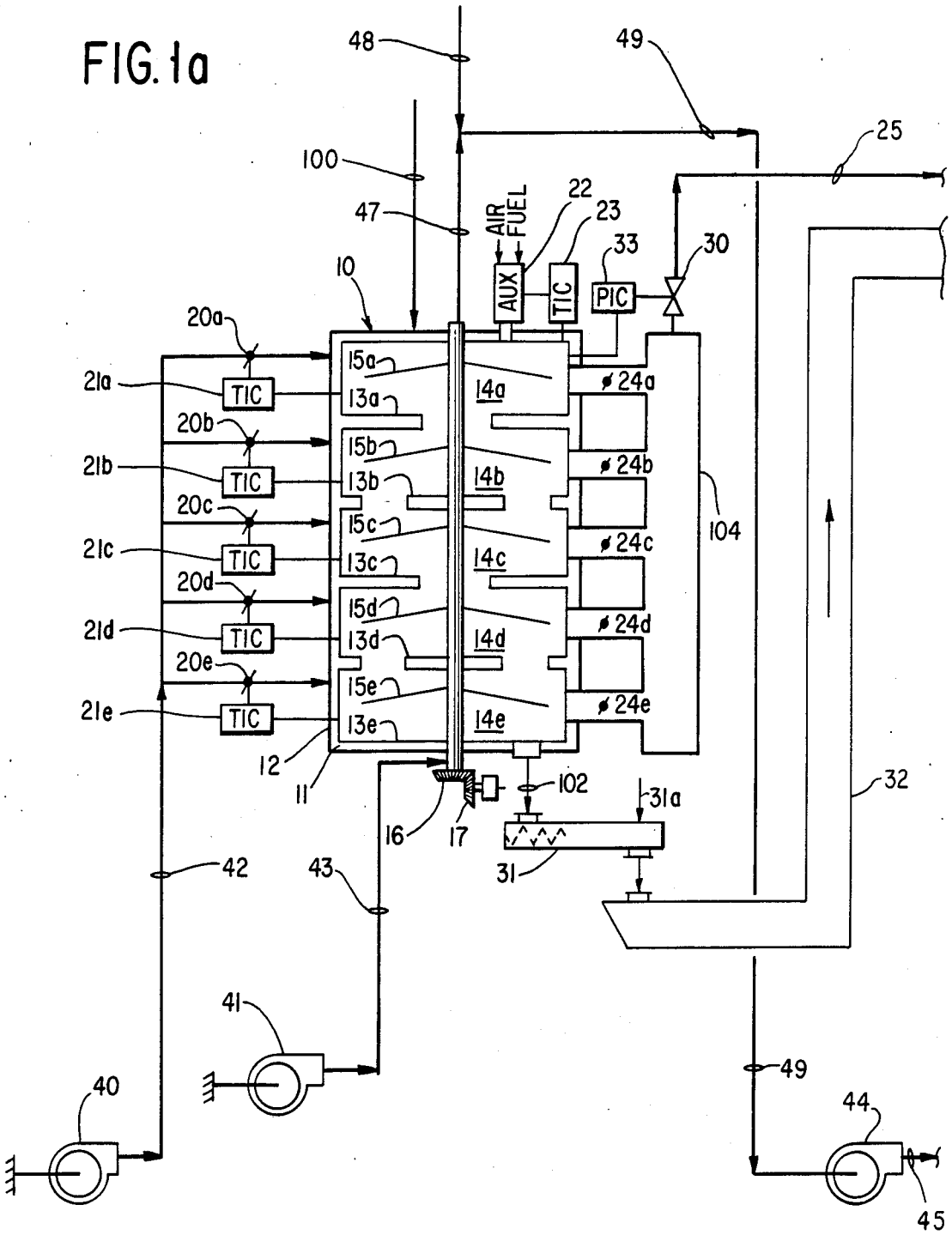
FIGS. 1*a* and 1*b* are schematic drawings of the present invention showing fuel and product gas flows through the furnaces and the low Btu gas burner.
Figure 1B:
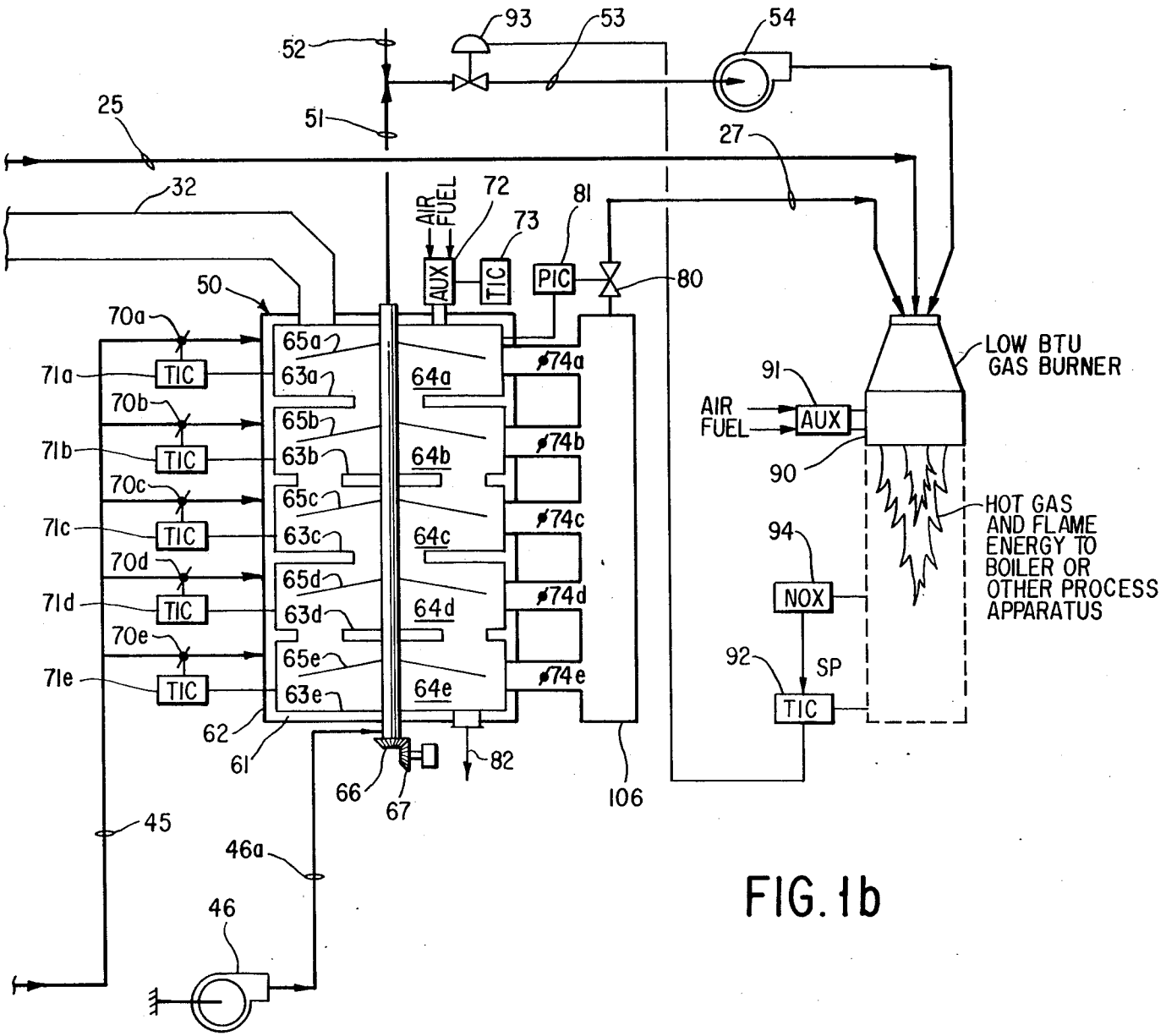

Referring now to FIGS 1*a* and 1*b*, there is shown a pair of multiple hearth furnaces 10, 50 standing in side by side relation. Furnace 10 operates in the reducing mode while furnace 50 is operated in the oxidizing mode. Furnace 10 is formed of a vertically oriented cylinder of conventional construction includinq a refractory lining 11 inside a steel shell 12. Within the furnace 10 there are a plurality of fixed superposed horizontal circular hearth floors 13*a,b,c,d,e* with drop holes, therby creating a number of hearth spaces 14*a,b,c,d,e*. A center shaft 16 extends vertically up through the center of the furnace to which are attached rabble arms 15*a,b,c,d,e*. The center shaft 16 is rotated by a shaft drive mechanism 17 which in turn moves the rabble arms across the floor of each hearth causing a raking action. In this manner, the fuel (organic material) which enters furnace 10 via duct 100 is moved sequentially across the staggered hearth floors where the volatile portion of the fuel is driven off under a reducing atmosphere thereby producing a low Btu gas which is collected and burned. The remaining char and ash leave furnace 10 via conduit 102. Cooling air from blower 41 enters shaft 16 via conduit 43, is heated and exits via conduit 47. The preheated air is mixed with ambient air entering via conduit 48 in conduit 49. This mixed air enters blower 44 for use with furnace 50.

Reducing furnace 10 includes dampers 20*a,b,c,d,e* which control combustion air to each hearth space 14*a,b,c,d,e*, respectively. Temperature controllers 21*a,b,c,d,e* individually monitors the hearth temperature and modulates the associated damper to maintain the temperature setpoint, by modulating in a reverse action direction, i.e., as the temperature increases above the setpoint the damper closes; as the temperature decreases below the setpoint the damper opens. The temperature controls utilized for each reducing hearth are designed to eliminate over-temperature excursions, subsequent slagging and NOx emission problems. Means are also provided to handle start-up and interrupted feed conditions, as more particularly shown in FIG. 2, and which will be later described.

The uppermost hearth 13*a* of the reducing furnace 10 includes a conventional auxiliary burner or burners 22 which is used during startup to preheat the furnace. Once fuel is introduced, sufficient heat is liberated to sustain the combustion without the need for the auxiliary burner 22. A temperature controller 23 monitors the hearth temperature and modulates the burner 22 in a reverse action direction. Burner 22 is of a conventional design with the fuel used being gas or oil and calibrated to maintain an air-fuel ratio slightly in excess of one.

The oxidizing furnace 50 is similar in construction to the reducing furnace 10 and includes a refractory liner 61 inside a steel shell 62. The actual number of hearth spaces inside the furnace 50 may be greater or less than in furnace 10 depending on the anticipated fuel analysis. For illustration purposes, the number of hearths in each furnace are the same, namely, five. Within the oxidizing furnace 50 horizontal hearths 63*a,b,c,d,e* with associated drop-holes are positioned, thereby creating hearth spaces 64*a,b,c,d,e*. A center shaft 66 extends vertically up through the center of the furnace to which are attached rabble arms 65*a,b,c,d,e*. Center shaft 66 is rotated by shaft drive mechanism 67 which in turn moves the rabble arms across the floor of each hearth, causing a raking action. In this manner the char from reducing furnace 10 which enters oxidizing furnace 50 via elevator 32 is moved sequentially across the hearth floors where it is completely oxidized. The resulting minerals and ash exit furnace 50 at 82 for disposal. Cooling air for shaft 66 is provided by blower 46 via conduit 46*a*. After being heated, that air leaves via conduit 51 where it is mixed with ambient air which enters via conduit 52 and then is transported via conduit 53 to blower 54.

Oxidizing furnace 50 includes dampers 70*a,b,c,d,e* which respectively control combustion air provided by blowers 41 and 44 via conduit 45 to each hearth space. Temperature controllers (TIC) 71*a,b,c,d,e* monitor the hearth temperature and modulates the associated damper 70 to maintain the temperature setpoint, by modulating in a forward action direction, i.e., as the temperature increases above the setpoint the damper opens; as the temperature decreases below the setpoint the damper closes. By operating the oxidizing furnace 50 in an excess air mode, the maximum possible burnout rate of fixed carbon occurs in each hearth. The gases which evolve in oxidizing furnace 50 contain significant free oxygen. This off-gas stream is collected in duct 106 after passing dampers 74*a,b,c,d,e* where it is then used as combustion air in the low Btu gas burner 90.

The uppermost hearth 63*a* of the oxidizing furnace 50 includes a conventional auxiliary burner or burners 72, similar in design and function as burner 22. The associated temperature controller 73, which monitors the temperature of hearth 63*a* of furnace 50 modulates the burner in a reverse action direction. The auxiliary burner 72 can also function to re-ignite the char material that has been introduced into the uppermost hearth 63*a* since the transport of the char from the lowermost hearth of the reducing furnace 10 may result in cooling below the ignition temperature. Auxiliary burners 22 and 72 can also be used continuously to supply supplemental heat when burning fuels of high moisture contents such that autogenous combustion conditions are not achieved.

Gas burner 90 is designed for use of fuel gases with a low heating value, such as might be produced by gasifiers or methane producing waste fermentation. Collected gases from the reducing furnace 10 and from the oxidizing furnace 50 are introduced into the low Btu gas burner 90 through conduits 25 and 27, respectively, as the fuel gas. Combustion air is introduced into the burner 90 from two sources: shaft cooling air duct 51 and ambient air duct 52 provided by blower 54 and gas collected from the oxidizing furnace in duct 106 via duct 27. A major portion of combustion air supplied by blower 54 is modulated through damper 93 by temperature controller 92, whih measures the temperature of the combusted gas stream output of the low Btu gas burner at a point after the radiant energy absorbinq section of the process apparatus that the burner is firing into.

The temperature controller 92 is a forward acting controller, acting to open damper 93 in response to an increase in measured temperature above setpoint to admit more make-up combustion air. Temperature controller 92 is set to maintain a temperature which is safely below temperatures which would cause slagging or NOx emission problems. The exact temperature setting for temperature controller 92 will be determined by fuel analysis and trial burns. Agricultural and forest waste product fuels typically will have fines carryover and ash composition such that slagging occurs at temperatures well below those attainable at typical coal fired excess air conditions of 20–40% excess air. Typically, for high nitrogen fuels the low Btu gas burner 90 operates at a temperature of about 1900° F.

In the event slagging is not a significant problem with the fuel being combusted, alternate control strategies for the operation of burner 90 may be employed to achieve greater combustion efficiencies. A NOx analyzer and controller 94 is preferably included to measure the NOx content of the exhaust gases, and to adjust the setpoint of the temperature controller to maintain NOx levels just below the allowable limits set by governmental agencies, e.g, E.P.A. This control strategy may be feasible with agricultural and forest waste product fuels also, if NOx emissions are a dominating factor at temperatures lower than those dictated by slagging considerations. If neither slagging nor NOx emissions are dominant factors, an excess oxygen monitor (not shown) may be placed in the exhaust gases to modulate the make-up combustion air to minimize excess oxygen. This type of control system is conventional for fossil fuel plants where NOx emissions are not a limiting factor.

Burner 90 includes a conventional auxiliary burner 91, which functions as a standing pilot. The auxiliary burner may be gas or oil fired, and is fired at a constant rate. The size and flame pattern of auxiliary burner 91 is determined by gas flow patterns within the main burner 90, and must be adequate to maintain a flame under all anticipated swings in operating conditions.

The main burner 90 is desirably fired into a waterwall boiler section or other thermal apparatus with significant radiation absorbing surface, to cause energy absorption by radiation from the flame. Without radiation heat transfer, hiher quantities of excess air will be required to maintain the desired operating temperature, resulting in lower overall combustion efficiencies.

In carrying out the method aspects of the present invention, it is seen that the fuel (waste products) to be burned is continually introduced into reducing furnace 10 via line 100 where it is moved in serpentine fashion through the furnace 10 from the uppermost hearth space 14*a* to the lowermost hearth space 14*e*. A reducing atmosphere is maintained in each hearth space 14*a–e*, by controlling the quantity of air flow from blower 40 through each inlet damper 20*a–e*. The fuel is gradually reduced to char with primarily mixed carbon remaining. Approximately 50–70% of the mass of the fuel is removed. The remaining char is discharged through duct 102 located at the lower hearth space 14*e*. The evolved volatile hydrocarbons containing methane, hydrogen, etc. are collected in duct 104 after passing through dampers 24*a,b,c,d,e*. These off-gas dampers 24 are adjusted to minimize gas flow between hearths and minimize off-hearth gas velocity, thereby reducing fines carry-over. Control of the off-gases from furnace 10 is maintained by valve 30 and controller 33 into burner 90 for combustion via duct 25.

The char formed in furnace 10 exits the furnace at 102 and is either directly or indirectly cooled with water in screw conveyor 31 to lower the char temperature to within normal operating conditions of conventional conveying equipment. The char is then fed to a bucket-elevator 32 for introduction into the oxidizing furnace 50, or, is diverted to a product storage bin for accumulation as an end product. Additional char feed can be introduced from char storage (not shown) to the screw conveyor 31 at feed point 31*a*, if desired. Thus, fuels having very low fixed-carbon content can be supplemented, either by the introduction of char alone, or a composite feed stock.

The oxidizing furnace 50 is operated at a temperature of about 1400° F. The temperature is maintained with a conventional temperature controller which uses thermocouples or the like. An oxygen excess of preferably from 1–2 times the stoichiometric requirement is introduced from blower 44 via duct 45 through inlet dampers 70*a–e*. The fuel (char) is thereby burned in furnace 50 and yields an ash residue which is discharged from the lower hearth 63*e* via opening 82. The hot gaseous products of combustion which contain excess oxygen are collected from each hearth zone in duct 106 after passing exit dampers 74*a,b,c,d,e*. Control of the oxidation gases leaving furnace 50 is maintained by valve 80 and controller 81 and then the gases are transported via duct 27 to burner 90.

Figure 2:
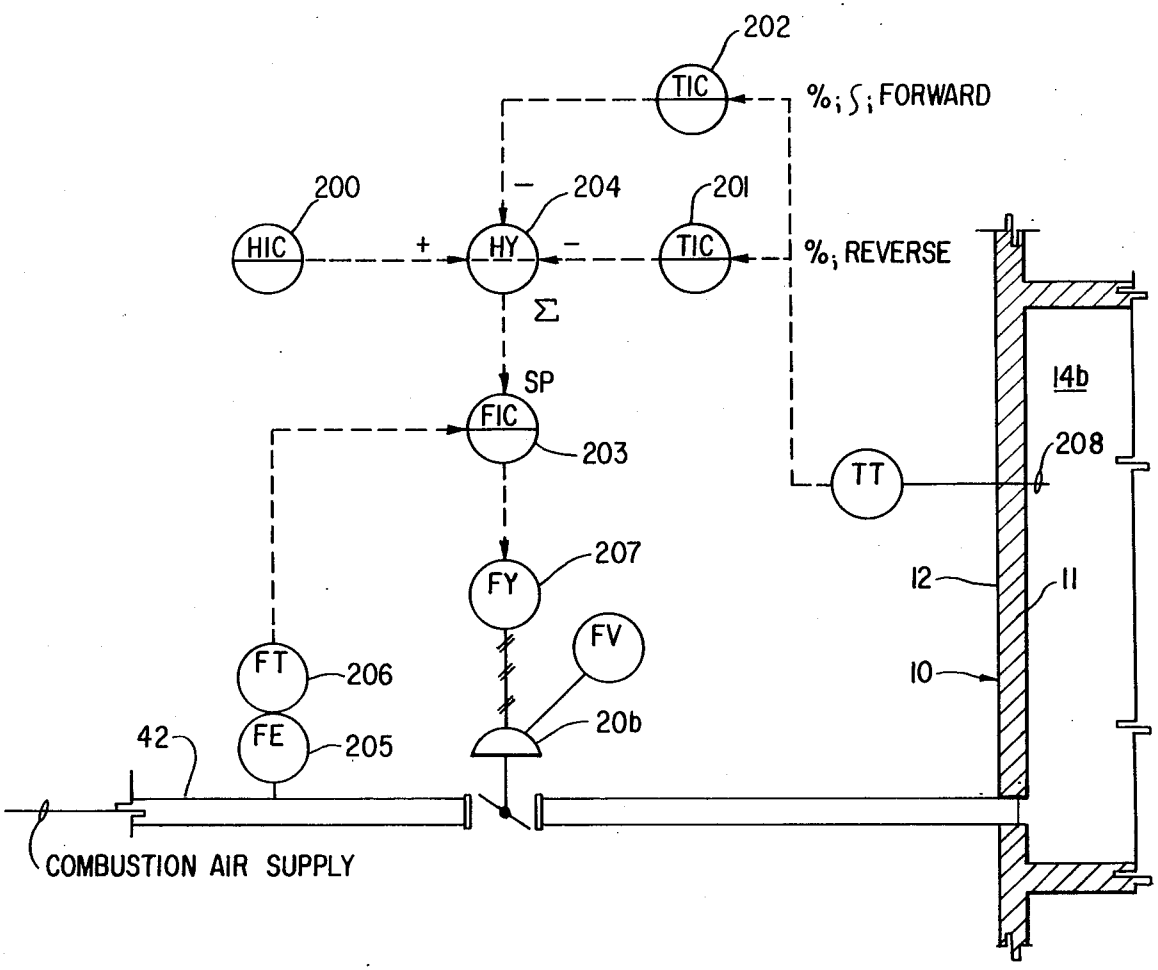
FIG. 2 is a schematic drawing of the present invention howing a control system loop for the reducing zone hearths.

Having described the overall process and system for burning solid agricultural waste products, attention will be given to another aspect of the present invention, namely, the control system employed for the reducing furnace 10, as shown more particularly in FIG. 2 of the drawings. The control system shown in FIG. 2 is representative of the controls for a single hearth, previously shown in a simplified form as TIC 21*a–e* in FIG. 1*a*. Each hearth space of the reducing furnace 10 includes an identical set of controls which may be individually controlled to maintain the desired temperature and atmosphere in each hearth space. The control system employed is primarily a flow-control loop, with measured flow feedback. The setpoint for the flow loop is derived as a summation of the signals from manual setpoint station 200, a low temperature controller 201, and a high temperature controller 202.

The manual setpoint is established on the basis of prior analysis of the fuel, and is set to be the maximum theoretical combustion air required at design loading of the furnace for the particular hearth. This, in effect, is the upper limit on the amount of combustion air allowed to enter that hearth via the combustion air damper 20*b*. The action of the temperature controllers 201 and 202 can only cause a decrease in the amount of combustion air introduced into hearth space 14*b*.

The function of temperature controller 202 is to limit the deviation of hearth temperatures above a preset limit. This controller is tuned with both proportional and integral terms, so that deviation above setpoint can always be reduced to zero. By adjusting manual setpoint station 200, the flow setpoint of the flow controller 203 can be increased to the point of forcing temperature controller 202 to be active. By this approah the fuel combustion rate is optimized while still meeting the high temperature limit at all times.

By cascading the output of temperature controller 202 into the setpoint of flow controller 203, several process advantages are realized over using a temperature controller directly to modulate the combustion air damper 20*b*:

1. Combustion-air supply pressure variations and furnace draft variations will not affect flow-rate/temperature stability.

2. Instantaneous maximum combustion air flow excursions are positively eliminated by the action of flow controller 203 and thereby will prevent hot-spot burning and ensuing slagging, fouling, and increased NOx emissions.

3. The control action output of temperature controller 202 is linear across the range of all operating conditions.

4. Temperature controller 202 can be tuned with faster responding proportional and integral settings without the possibility of gross over-firing and over-temperature upsets. This will maximize combustion capacity while guarding against over-temperature adverse affects.

Temperature controller 201 is included to limit air flow during low-temperature excursions caused during start-up, interrupted feed, low-feed, or extinguished-fire conditions. The normal response for a reverse acting-only temperature control would be to increase air-flow with measured temperature below setpoint. That response would cause a response in the opposite direction if desired under the conditions just mentioned. Controller 201 limits air flow until the temperature measured by a suitable sensing element 208, e.g., thermocouple, indicates that proper fuel feed rate and combustion conditions have been established. It should be noted that the negative sign conventions for the temperature controller inputs to the summation relay 204 causes a reversal in the actual operating direction effect of the controllers; controller 202 as a unit is forward-acting, but reverse-acting in effect; controller 201 as a unit is reverse-acting but forward-acting in effect.

Air entering hearth space 14*b* via duct 42 is measured by flow element 205 and a signal is transmitted by flow transmitter 206 to flow controller 203 which in turn acts on flow relay 207 to operate damper 20*b*.

Figure 3:
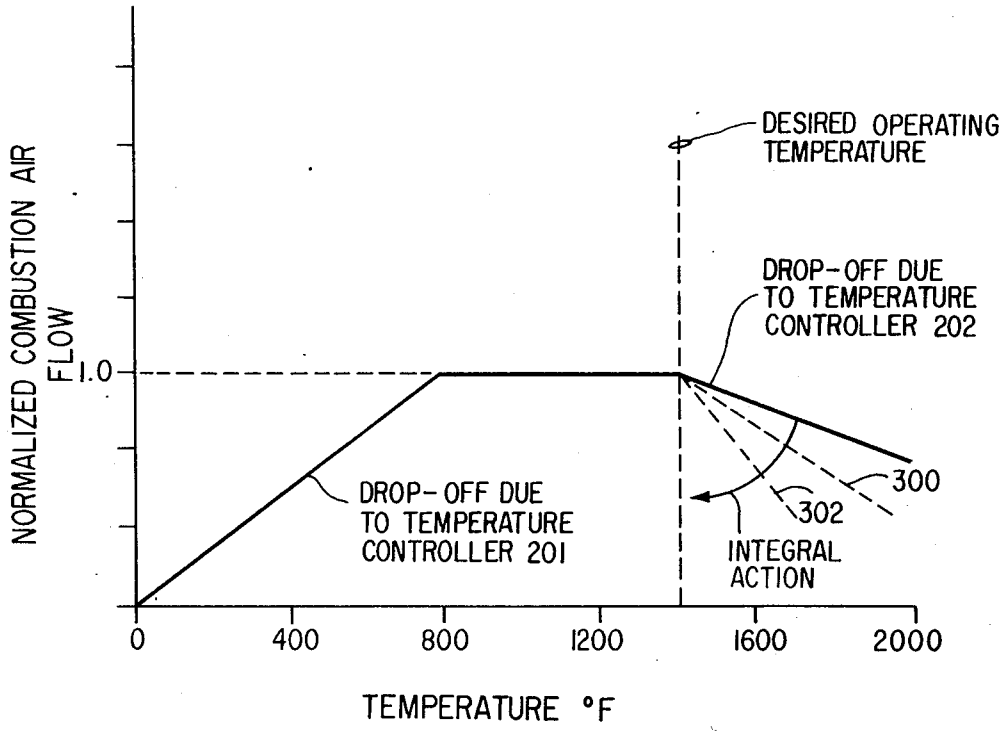
FIG. 3 is a graph which shows the control system response for combustion air input to reducing zone hearths as a function of hearth temperature.

In FIG. 3, the action of the control system employed in connection with reducing furnace 10 is graphically shown. The air flow to each hearth space is initially manually set at an optimum value of 1.0, depending on the nature of the fuel used, the quantity burned, etc. If the desired operating temperature of 1400° F. is exceeded in one or more of the hearth spaces, the control system will act to decrease the air into that hearth space by shutting the inlet damper at the respective hearth space. Should the temperature not decrease, the damper will continue to close (as shown by the dashed lines 300, 302). Similarly, should the temperature in the heath space fail to reach 800° F., the inlet damper will close. In this manner fuel is treated at the optimum temperature to ensure volatilization under reducing conditions.

The following example is presented which illustrates the operation of the present invention.

About 20,000 lbs./hr. cotton stalks having a 10% moisture content and heating value of 7300 Btu/lb. are fed into the reducing furnace at 60° F. The furnace is operated at 1600° F., initially by means of the auxiliary burner 22 and threafter by the burning of the fuel being continuously introduced. The rate of air entering furnace 10 from blower 40 is 6800 scfm at 60° F., whih provides about 25% of the stoichiometric oxygen requirements for the fuel. The rotating shaft 16 is cooled using 3000 scfm air at 60° F. That cooling air is heated and exits at duct 47 where it is mixed with ambient air which enters the blower 44 via duct 49 at a temperature of about 120° F.

After being partially combusted in furnace 10, about 6400 lb./hr. char and ash exits furnace 10 at a temperature of about 1600° F. The char and ash are mehanically conveyed by elevator 32 to the oxidizing furnace 50 where complete oxidation of the unburned fixed carbon takes place. Approximately 1800 lbs./hr. ash exits furnace 50 at a temperature of about 1400° F., which is the operating temperature of furnace 50.

To sustain the combustion process in furnace 50, about 28,000 scfm air preheated to about 120° F. is provided by blower 44 via duct 45. The rotating shaft 66 is cooled with about 4500 scfm air from blower 46 via duct 46*a*. That cooling air exits the furnace via duct 51 at an elevated temperature and is mixed with about 12,000 scfm ambient air from duct 52, thereby entering blower 54 at a temperature of about 140° F. That air is regulated by damper 93 and is fed into burner 90.

Burner 90 operates at a temperature of about 1900° F. using 75% excess air. 11,000 scfm low Btu gas having a heating value of about 180 Btu/scf at a temperature of 1600° F. is collected from reducing furnace 10 at 104 and fed directly into burner 90 where it is burned. 30,000 scfm low oxygen gases at 1400° F. is collected from oxidizing furnace 50 at 106 and fed directly into burner 90 via duct 27.

By this example, it can be readily seen that a substantial portion of the heat content of the waste material being burned is recovered and used to heat approximately 90,000 lbs./hr. water to a temperature of about 750° F. Moreover, the present invention results in a minimum discharge of NOx or fines into the atmosphere.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A process for continuously burning solids comprising the steps:

a. partially burning said solid in a first multiple hearth furnace which is operated under reducing conditions and forming a carbon-containing char and a low Btu gas in said first multiple hearth furnace;

b. recovering said char from said first multiple hearth furnace and conveying said char to a second multiple hearth furnace which is operated under oxidizing conditions;

c. substantially completely burning the char recovered from said first multiple hearth furnace in said second multiple hearth furnace;

d. transporting said low Btu gas from said first multiple hearth furnace to a burner where substantially complete burning of said low Btu gas takes place; and e. recovering oxygen containing gas from from said second multiple hearth furnace and utilizing said gas in said burner for burning said low Btu gas recovered from said first multiple hearth furnace.

2. The process according to claim 1 wherein one or more of the hearths of said first multiple hearth furnace includes temperature and air flow sensors, initially manually adjusting the air flow to said hearth for a predetermined operating temperature in said hearth, automatically adjusting said air to said hearth when the operating temperature in said hearth is above or below the preset temperature range.

3. The process according to claim 1 wherein one or more of the hearths of said first multiple hearth furnace includes temperature and air flow sensors, initially manually adjusting the air flow to said hearth for a predetermined operating temperature in said hearth, automatically adjusting said air to said hearth when the operating temperature in said hearth is above or below the preset temperature range.

4. The process according to claim 1 further including the steps of introducing agricultural waste products into said first multiple hearth furnace and monitoring the NOx content of said gases in said low Btu gas burner.

5. The process according to claim 1 further including the steps of providing a rotating shaft in said second multiple hearth furnace, cooling said shaft with internally provided air, recovering said air from said second multiple hearth furnace at an elevated temperature and introducing said recovered heated air into said burner to support combustion of said low Btu gas from said first multiple hearth furnace.

6. The process according to claim 5 wherein one or more of the hearths of said first multiple hearth furnace includes temperature and air flow sensors, initially manually adjusting the air flow to said hearth for a predetermined operating temperature in said hearth, automatically adjusting said air to said hearth when the operating temperature in said hearth is above or below the preset temperature range.

7. The process according to claim 1 further including the steps of providing a rotating shaft in said first multiple hearth furnace, cooling said shaft with internally provided air, recovering said air from said first multiple hearth furnace at an elevated temperature and introducing said recovered heated air into said second multiple hearth furnace to support combustion of said char.

8. The process according to claim 7 wherein one or more of the hearths of said first multiple hearth furnace includes temperature and air flow sensors, initially manually adjusting the air flow to said hearth for a predetermined operating temperature in said hearth, automatically adjusting said air to said hearth when the operating temperature in said hearth is above or below the preset temperature range.

9. The process according to claim 7 further including the steps of providing a rotating shaft in said second multiple hearth furnace, cooling said shaft with internally provided air, recovering said air from said second multiple hearth furnace at an elevated temperature and introducing said recovered heated air into said burner to support combstion of said low Btu gas from said first multiple hearth furnace.

10. The process according to claim 9 wherein one or more of the hearths of said first multiple hearth furnace includes temperature and air flow sensors, initially manually adjusting the air flow to said hearth for a predetermined operating temperature in said hearth, automatically adjusting said air to said hearth when the operating temperature in said hearth is above or below the preset temperature range.

11. Apparatus for continuously burning solids comprising:

a. a first multiple hearth furnace including means for partially burning said solids under reducing conditions to form a carbon-containing char and for producing a low Btu gas from said solid being partially burned;

b. a second multiple hearth furnace spaced from said first multiple hearth furnace including means for substantially completely burning said carbon-containing char under oxidizing conditions;

c. means for transporting said low Btu gas from said first multiple hearth furnace to a burner where substantially complete burning of said low Btu gas takes place; and d. means for transporting oxygen-containing gas recovered from said second multiple hearth furnace and utilizing said gas in said burner for burning said low Btu gas recovered from said first multiple hearth furnace.

12. The apparatus according to claim 11 wherein one or more of the hearths of said first multiple hearth furnace includes temperature and air flow sensors, manual adjusting means for determining the air flow to said hearth for a predetermined operating temperature in said hearth, temperature sensing means for automatically adjusting said air to said hearth when the operating temperature in said hearth is above or below the preset temperature range.

13. The apparatus according to claim il wherein said solids comprise agricultural waste products introduced into said first multiple hearth furnace and further including means for monitoring and controlling the NOx content of said gases in said low Btu gas burner.

14. The apparatus according to claim 11 including external means for transporting said char from said first multiple hearth furnace to said second multiple hearth furnace.

15. The apparatus according to claim 14 wherein one or more of the hearths of said first multiple hearth furnace includes temperature and air flow sensors, manual adjusting means for determining the air flow to said hearth for a predetermined operating temperature in said hearth, temperature sensing means for automatically adjusting said air to said hearth when the operating temperature in said hearth is above or below the preset temperature range.

16. The apparatus according to claim 11 further including a rotating shaft in said second multiple hearth furnace, air cooling means for said shaft, means for transporting said air from said second multiple hearth furnace at an elevated temperature into said burner to support combustion of said low Btu gas from said first multiple hearth furnace.

17. The apparatus according to claim 16 wherein one or more of the hearths of said first multiple hearth furnace includes temperature and air flow sensors, manual adjusting means for determining the air flow to said hearth for a predetermined operating temperature in said hearth, temperature sensing means for automatically adjusting said air to said hearth when the operating temperature in said hearth is above or below the preset temperature range.

18. The apparatus according to claim 11 further including a rotating shaft in said first multiple hearth furnace, air cooling means for said shaft, means for tranporting said air from said first multiple hearth furnace at an elevated temperature into said second multiple hearth furnace to support combustion of said char.

19. The apparatus according to claim 18 wherein one or more of the hearths of said first multiple hearth furnace includes temperature and air flow sensors, manual adjusting means for determining the air flow to said hearth for a predetermined operating temperature in said hearth, temperature sensing means for automatically adjusting said air to said hearth when the operating temperature in said hearth is above or below the preset temperature range.

20. The apparatus according to claim 18 further including a rotating shaft in said second multiple hearth furnace, air cooling means for said shaft, means for transporting said air from said second multiple hearth furnace at an elevated temperature into said burner to support combustion of said low Btu gas from said first multiple hearth furnace.

21. The apparatus according to claim 20 wherein one or more of the hearths of said first multiple hearth furnace includes temperature and air flow sensors, manual adjusting means for determining the air flow to said hearth for a predetermined operating temperature in said hearth, temperature sensing means for automatically adjusting said air to said hearth when the operating temperature in said hearth is above or below the preset temperature range.

22. The apparatus according to claim 21 including external means for transporting said char from said first multiple hearth furnace to said second multiple hearth furnace.

23. The apparatus according to claim 21 wherein said solids comprise agricultural waste products introduced into said first multiple hearth furnace.

24. The apparatus according to claim 23 further including means for monitoring and controlling the NOx content of said gases in said low Btu gas burner.

25. The apparatus according to claim 21 further including means for monitoring and controlling the NOx content of said gases in said low Btu gas burner.

26. The apparatus according to claim 25 including external means for transporting said char from said first multiple hearth furnace to said second multiple hearth furnace.

* * * * *

UNITED STATES PATENT AND TRADEMARK OFFICE

CERTIFICATE OF CORRECTION

PATENT NO. : 4,679,268

DATED : July 14, 1987

INVENTOR(S) : RICHARD M. GURRIES et al

It is certified that error appears in the above-identified patent and that said Letters Patent is hereby corrected as shown below:

IN THE SPECIFICATION:

Column 1, line 16, "availbility" should be --availability--;

lines 20 and 21, "relationhip" should be --relationship--;

lines 67 and 68, "disharqe" should be --discharge--.

Column 6, line 18 "whih" should be --which--;

line 20, "absorbinq" should be --absorbing--;

line 68 "hiher" should be --higher--.

Column 8, line 17, "approah" should be --approach--.

Column 9, line 7, "heath" should be --hearth--;

line 19, "whih" should be --which--;

line 28, "mehanically" should be --mechanically--.

UNITED STATES PATENT AND TRADEMARK OFFICE

CERTIFICATE OF CORRECTION

PATENT NO. : 4,679,268

DATED : July 14, 1987

INVENTOR(S) : RICHARD M. GURRIES et al

It is certified that error appears in the above-identified patent and that said Letters Patent is hereby corrected as shown below:

IN THE CLAIMS:

Claim 1, line 16, "oxygen containing" should be --oxygen-containing--;

line 16, delete second occurrence of --from--.

Claim 9, line 9, "combstion" should be --combustion--.

Claim 13, line 1, "il" should be --ll--.

Signed and Sealed this

Twenty-ninth Day of December, 1987

*Attest:*

DONALD J. QUIGG

*Attesting Officer*

*Commissioner of Patents and Trademarks*